United States Patent [19]

White, Jr.

[11] Patent Number: 4,877,383

[45] Date of Patent: Oct. 31, 1989

[54] DEVICE HAVING A SEALED CONTROL OPENING AND AN ORBITING VALVE

[76] Inventor: Hollis N. White, Jr., 243 Pyle La., Hopkinsville, Ky. 42240

[21] Appl. No.: 282,675

[22] Filed: Dec. 12, 1988

Related U.S. Application Data

[63] Continuation of Ser. No. 80,606, Aug. 3, 1987, abandoned.

[51] Int. Cl.[4] ..... F01C 1/10; F01C 19/08; F17K 3/02

[52] U.S. Cl. ..... 418/61.3; 137/625.2

[58] Field of Search ..... 418/61.3; 137/625.2, 137/625.21

[56] References Cited

U.S. PATENT DOCUMENTS 3,233,524 2/1966 Charlson ..... 418/61 B
3,316,814 5/1967 Charlson ..... 418/61 B
3,364,907 1/1968 Jeanson ..... 418/61 B
3,825,376 7/1974 Petersen et al. ..... 418/61.3
3,876,343 4/1975 Giversen ..... 418/61.3

FOREIGN PATENT DOCUMENTS 56-60891 5/1981 Japan ..... 418/61 B

*Primary Examiner*—John J. Vrablik

[57] ABSTRACT

A gerotor device is disclosed wherein the pressurized fluid is segregated to the area of the device near the orbiting valve by the sealing of the wobblestick drive connection to the valve. In the preferred embodiment shown this sealing is accomplished by restricting the effective size of the drive opening through the valving plate of the manifold plate to an area less than that capable of being sealed by the inside drive surface of the valve.

9 Claims, 5 Drawing Sheets

DEVICE HAVING A SEALED CONTROL OPENING AND AN ORBITING VALVE

This is a continuation of co-pending application Ser. No. 80,606 filed on Aug. 3, 1987, abandoned.

FIELD OF THE INVENTION

This invention relates to hydraulic gerotor motor devices.

BACKGROUND OF THE INVENTION

Gerotor motor devices are a relatively low-cost way of transferring large amounts of torque into remote locations. Typical applications range from industrial robots, through agricultural mowers, to airplane controls. However, major limitations to increased applications of the motor devices include their wear characteristics (i.e. service life span including seal failure), longitudinal length (i.e. due to the orbital to rotary transition), their physical complexity (i.e. due to the numerous seals) and the difficulty of their repair. Attempts to reduce the effects of these limitations have produced such ideas as disposable motors, complex planetary gearing arrangements or offset drives, encapsulated motors and an "oversize the motor" design technique. These attempts have not markedly increased the utilization of gerotor motors—the increased cost/complexity of the devices do not meet with significant acceptance in the industries involved.

This present invention is directed towards providing a simple long lasting, short length, quickly exchanged gerotor motor.

SUMMARY OF THE INVENTION

The present invention is directed to providing an improved gerotor motor device.

It is an object of this invention to increase the service life of gerotor devices.

It is an object of this invention to reduce the longitudinal length of gerotor devices.

It is an object of this invention to facilitate the repair of gerotor devices.

It is an object of this invention to simplify gerotor devices.

Other objects and a more complete understanding of the invention may be had by referring to the following specification and drawings in which:

DESCRIPTION OF THE PREFERRED EMBODIMENT

Figure 1:
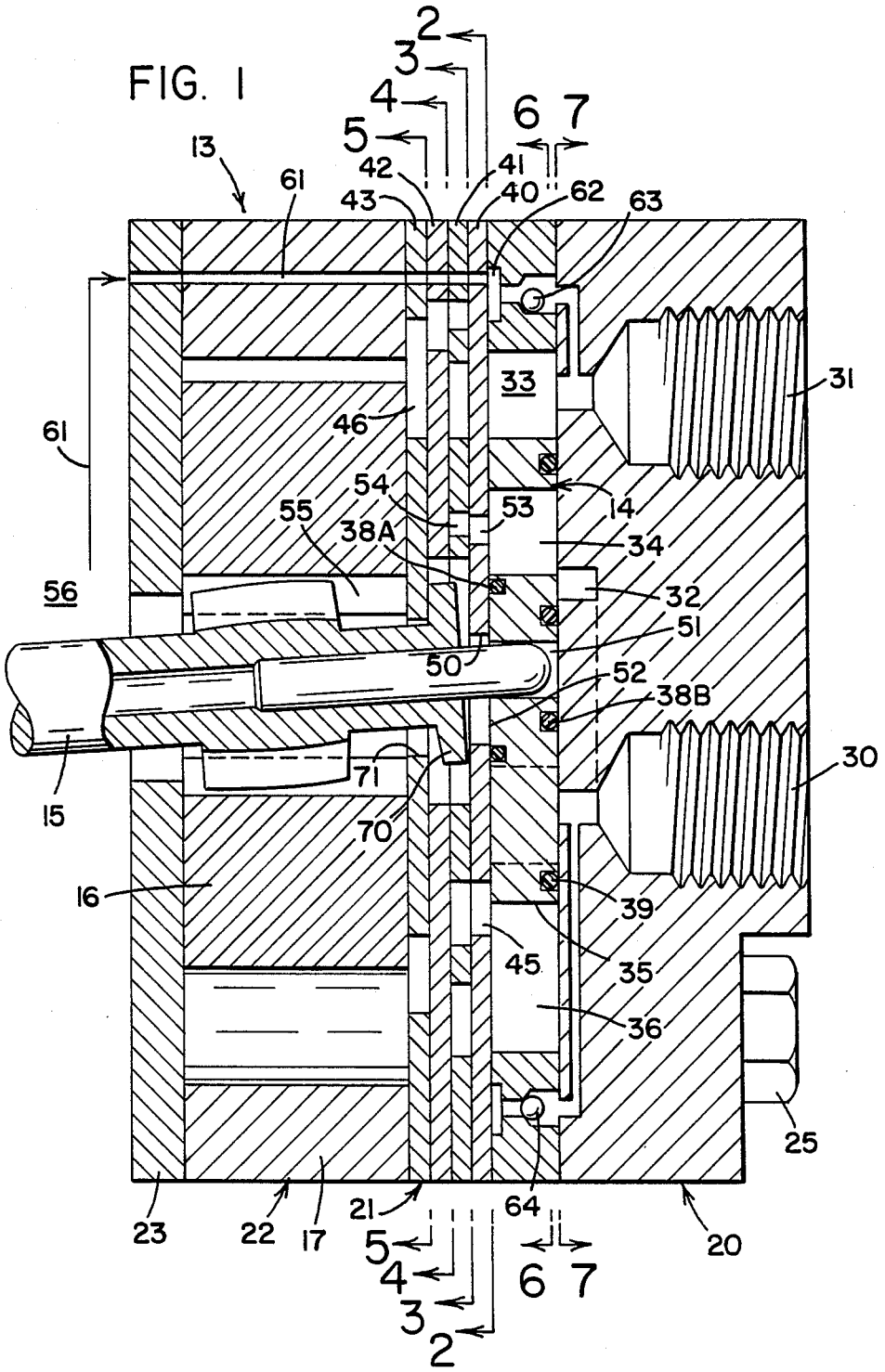
FIG. 1 is a central longitudinal cross-sectional view of a gerotor structure incorporating the invention.

This invention relates to an improved gerotor device. The invention will be described in the preferred environment of a gerotor motor/pump 10 a having a housing 11 containing a drive shaft 12 connected to a gerotor structure 13 and rotary valve 14 via a wobblestick 15

Figure 8:
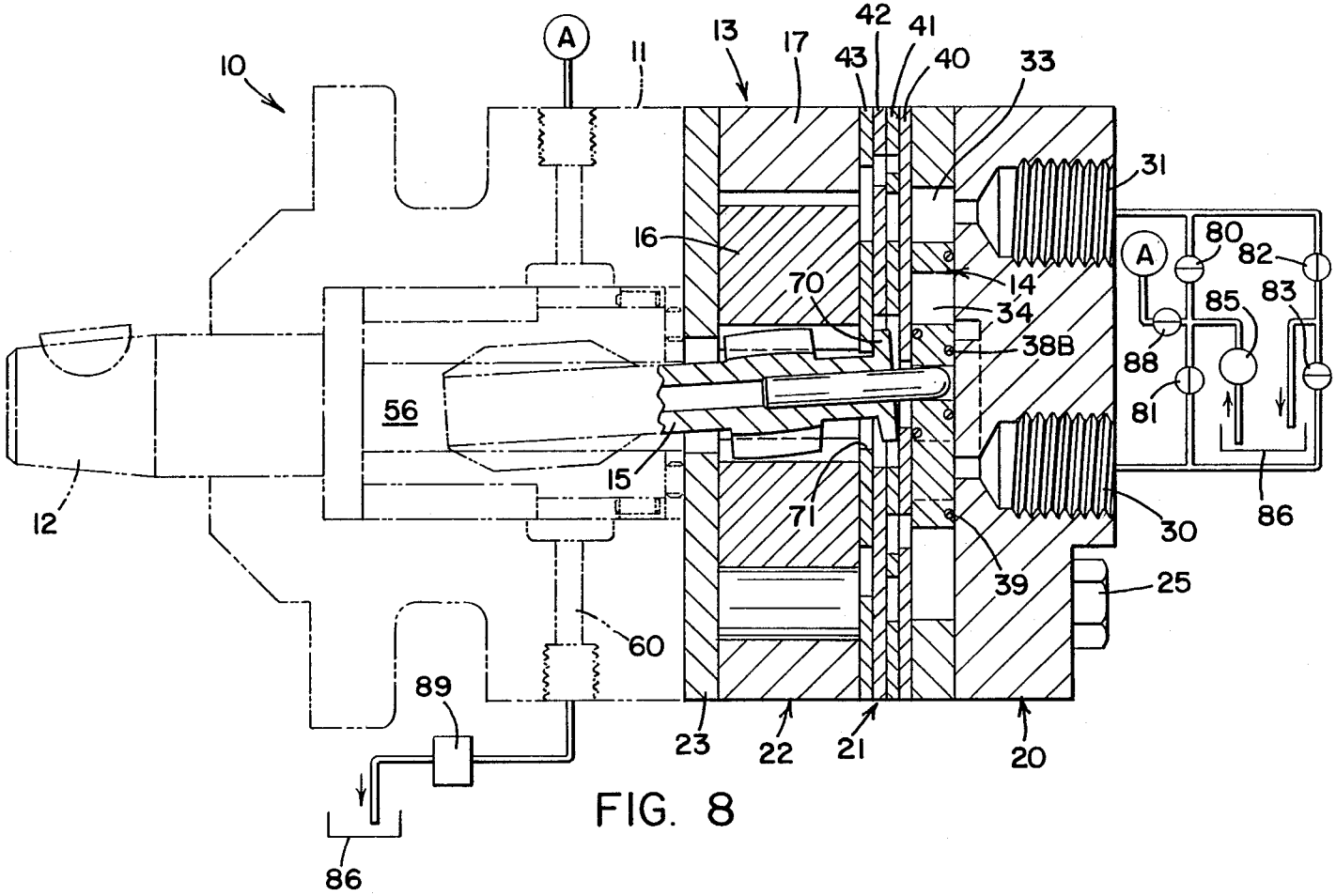
FIG. 8 is a central longitudinal cross-sectional view of a gerotor device incorporating the gerotor structure of FIG. 1.

(FIG. 8). (The gerotor device 10 can produce power when fluidically connected as a motor to a source of high pressure or it can produce high pressure fluid when physically connected as a pump to a motor (a source of rotary power). The device is described as a motor.)

The drive shaft 12 is located in the housing 11 for rotation in respect thereto. In a gerotor motor, such as that disclosed in Mr. White's prior patent U.S. Pat. No. 3,606,601, the speed and direction of rotation of this shaft 12 is governed by the volume, pressure and direction of flow of the fluid through the gerotor structure 13. In the embodiment shown the fluid flow through the device is controlled by four valves 80, 81, 82 and 83. These valves 80–83 are selectively operated to connect a port 30, 31 to a fluid pump 85 (source of pressurized fluid) and to connect the other port 30, 31 to the sump 86 (discharge of fluid) from which the pump 85 draws fluid. In the embodiment shown an auxiliary port A can be also selectively connected via valve 88 to the fluid pump 85 to lubricate and cool the bearings of the device if needed. A filter 89 filters this lubrication loop fluid before discharge to the sump 86, thus effectively isolating the lubrication function from the power function of the device. A totally separate fluid loop could also be utilized.

The shape of the housing 11 of this current motor/-pump 10 is designed to match the intended application, even to the extent of being integral thereto (a feature allowed by the isolation of fluid within the gerotor structure 13 as will be later described).

The gerotor structure 13 is removably attached to the housing 11, preferably by bolts (not shown). The gerotor structure 13 itself includes an end plate 20, a manifold plate 21, a gerotor device 22 and a balancing plate 23 fixedly attached together so as to produce a single integral unit (by bolts 25). The gerotor device shown is a rotor 16 within a stator 17 (FIG. 1). Other pressure mechanisms could also be used.

The end plate 20 is the termination cap and porting plate for the device 10. Two ports 30, 31 are machined into the plate 20 so as to form the fluid connections for the device. One port 30 connects to a commutation ring 32 in the opposing face of the plate 20. This commutation ring 32 in turn communicates with the central section 34 of the orbiting valve 14 to provide a fluid connection therefor. The other port 31 connects to a ring-shaped cavity 33 on the opposing side of the plate 20. This cavity 33 surrounds the outside circumferential edge 35 of the orbiting valve 14 to provide a second fluid connection to the valve 14.

The orbiting valve 14 is the main valve for the device 10. The center opening 34 of the valve 14 communicates with one port 30 via the ring 32. The external side about outer edge 35 of the valve 14 communicates with the other port 31. (Due to the fact that there is a space 36 between the outermost position 37 of the orbiting valve 14, fluid is able to freely move about the outside of the valve 14).

Figure 2:
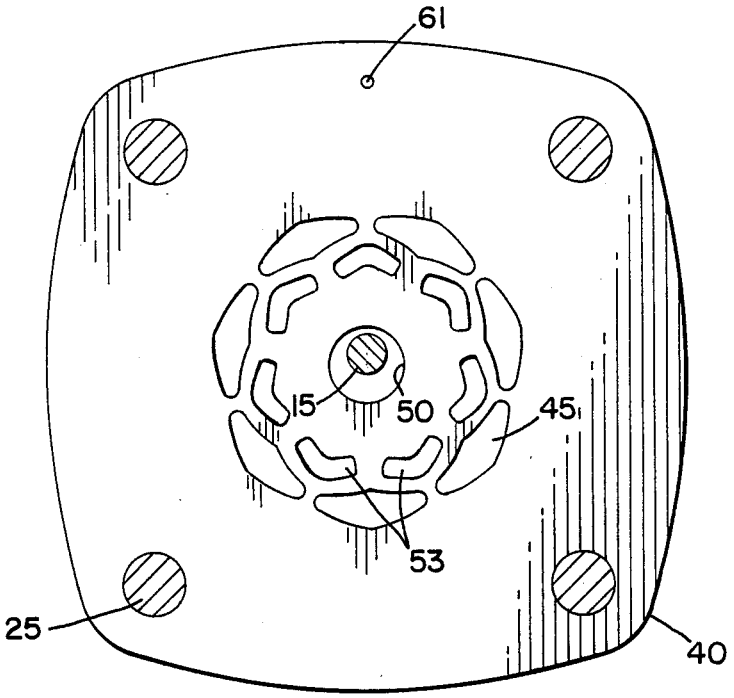
FIGS. 2–5 are selected lateral cross-sectional views of the manifold plate of the gerotor device of FIG. 1, FIGS. 6–7 are selected lateral cross-sectional views of the valving section of the gerotor device of FIG. 1.
Figure 3:
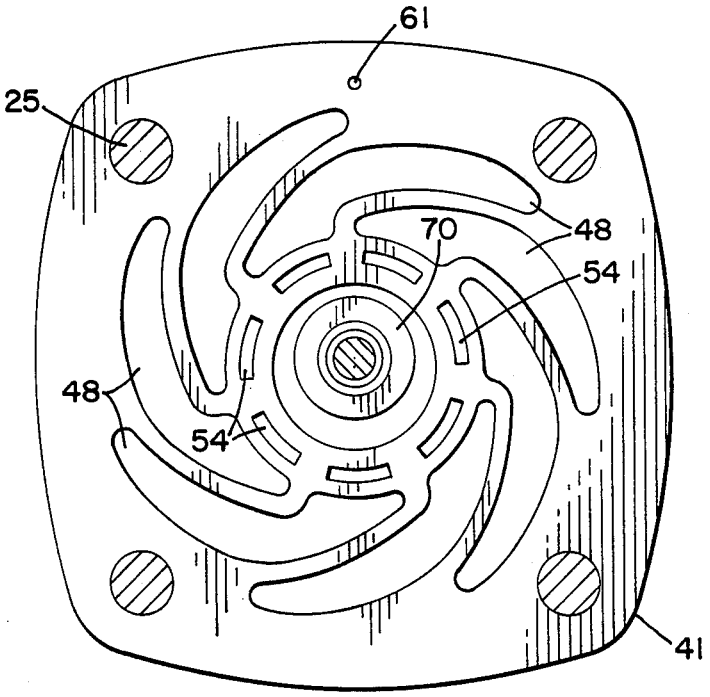
Figure 4:
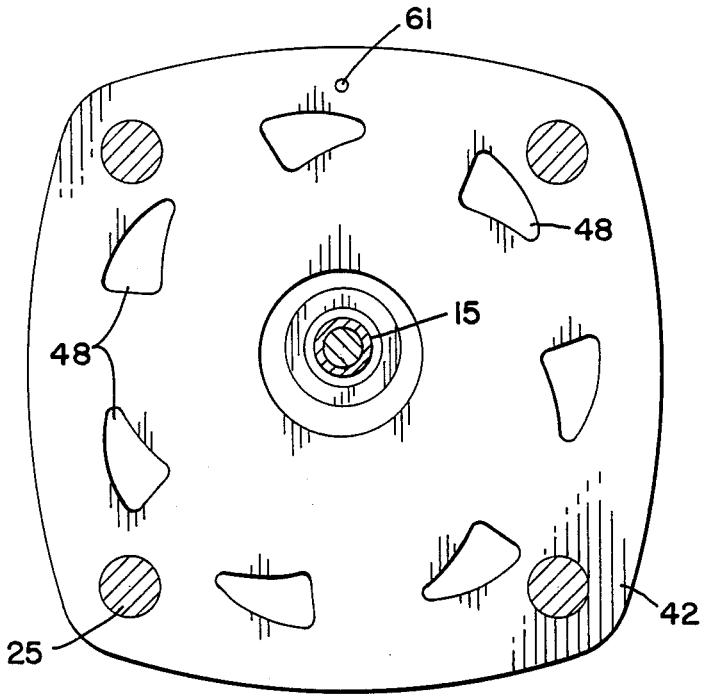
Figure 5:
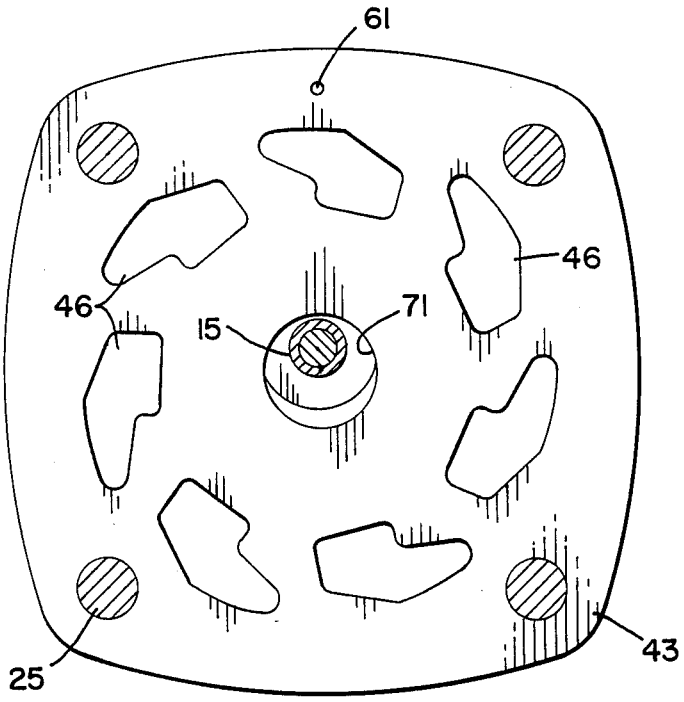
Figure 6:
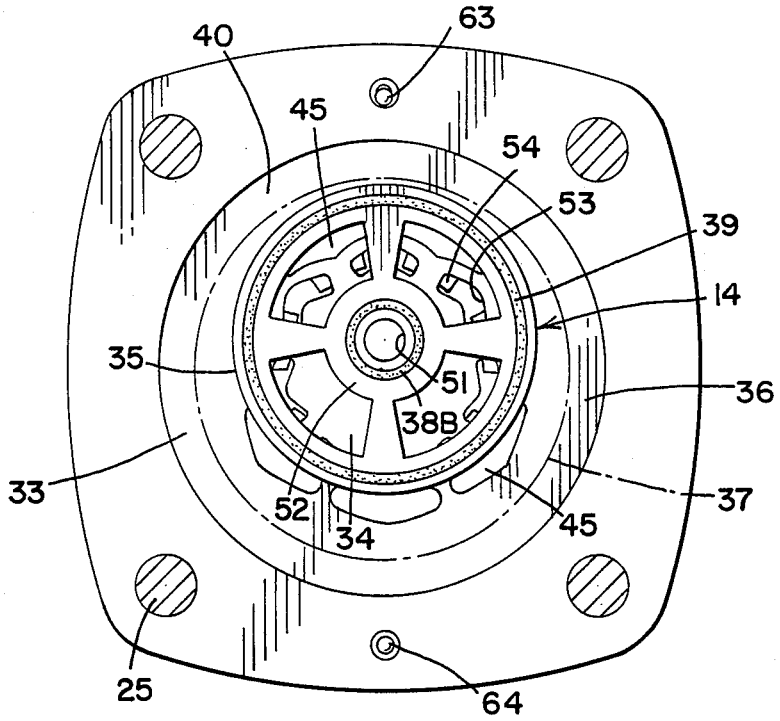
Figure 7:
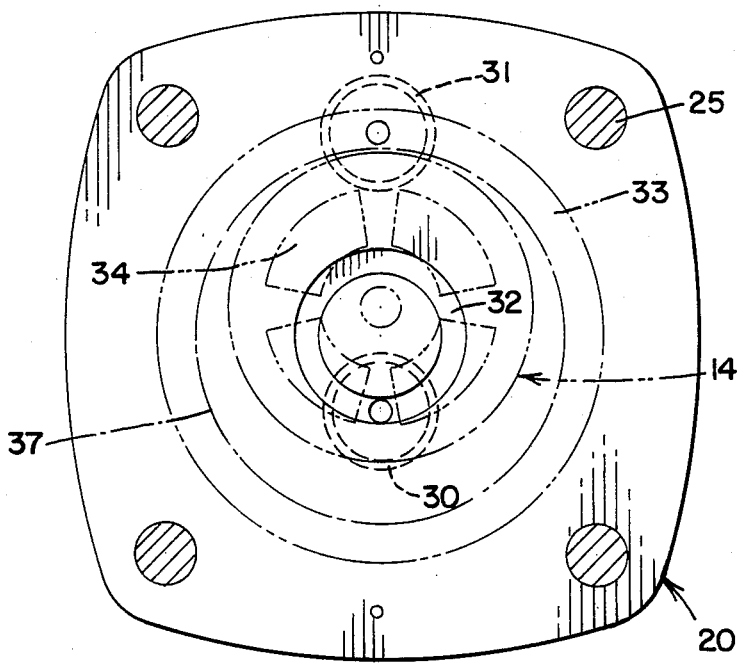

The manifold plate 21 is on the opposing side of the orbiting valve 14 from the end plate 20 between the valve 14 and rotor 16. The manifold plate 21 serves to connect the center 34 and outer 35 sections of the orbiting valve 14 to the gerotor cells between the rotor 16 and stator 17 selectively as the device is operated. The manifold plate 21 itself is formed as a brazed assembly of four thin stamped plates 40–43. The first plate 40 (FIGS. 2 and 6) provides the valve openings 45 for the device 10. The fourth plate 43 (FIG. 5) provides the outer gerotor cell openings 46 for the device 10. The second and third plates 41, 42 (FIGS. 3, 4) contain angularly shift passages 48 to connect the valving openings 45 and their respective gerotor cell openings 46 while compensating for the substantially 90 degree offset therebetween. To avoid having the orbiting valve restrict or otherwise impede the commutation of fluid from the port 30, a series of auxiliary flow paths 53, 54 in the plates 40, 41 are provided. The auxiliary flow openings 53 in plate 40 are staggered from the recesses 54 in plate 41 such that neighboring openings 53 communicate with each other through the recesses 54. In the embodiment shown these combine to form a supplementary flow path to the center opening 34 of the valve 14. The openings 53 in plate 40 bridge the radial arms of the valve 14 (as shown in FIG. 6). This effectively eliminates concern for the arms impeding fluid flow, technically to the extent of allowing one to make the valve 14 of a uniform depth in the center portion 52, radial arms and outermost portion 37 (i.e. eliminate the recessed portion of the radial arms of the valve 14). This uniform depth construction would increase the surface area of the valve 14 against the plate 40, strengthening the device against wear and pressure imbalance effects.

In the prior art gerotor motors the wobblestick extends from the rotor to the valve through a plate having a single uniform diameter. This allows the fluid to easily pass through the plate and rotor to pressurize the central wobblestick drive opening of the device, indeed the central wobblestick drive opening is even actively used as an internal conduit of pressurized fluid between a housing mounted port and the orbiting valve in most devices. Due to the containment of pressurized fluid within the central wobblestick drive opening in these prior art designs, the entire device is integral from the shaft 12 end plate 20 with numerous high pressure seals throughout the device.

The integralness of the device requires that all the rotary shaft, orbiting rotor and rotary to orbiting mechanical connection be contained within the device. This adds to the length of the device (the named parts all being of a certain length and size) and the weight of the device (the parts individually having weight). The integralness of the device also complicates the mounting of the device to associated components (the device needing a certain volume of space) and the repair of the device (the device needing to be totally removed mechanically and fluidly from associated components before repair). Other restrictions also follow the size of the device.

The seals are high pressure seals. These seals include a rotating seal between the main drive shaft and housing as well as a seal between the housing and gerotor structure. These high pressure seals add to the complexity and cost of the device in construction (high pressure seals are tight tolerance seals with intricate seat requirements) and repair (high pressure seals require care in handling). The seals also place operational restrictions on the device (the seals requiring a restricted range of operation). In addition to high pressure seal requirements, the fluid in the central drive opening also serves to contaminate the gerotor fluid with debris and heat from the central wobblestick drive, further reducing the service life of the device. The presence of this fluid also complicates repair by necessitating the removal of pressure and drainage of the fluid at the time of any work on the device. These disadvantages and others limit the market for the prior art devices.

In marked contrast to these prior art designs in the current invention pressurized fluid is not introduced into the central wobblestick drive opening unless desired (for example, a separate bearing lubrication loop in FIG. 8). The pressurized fluid is instead segregated to the area of the device near the orbiting valve 14 by the sealing of the wobblestick drive connection to the valve 14. In the preferred embodiment shown this sealing is accomplished by restricting the effective size of the drive opening 50 through the valving plate 40 of the manifold plate 21 to an area less than that capable of being sealed by the inside drive surface 52 of the valve 14. To accomplish this the radius of the drive surface 52 of the valve is slightly greater than the radius of the opening 50 plus the offset of the center of the valve 14 from the center of the valve manifold 21. With this relationship the inside drive surface 52 of the valve 14 will seal the opening 50 throughout the operational valving orbit of the valve 14. Central seals 38 improve the seal against fluid from passing into the wobblestick drive connection at the center of the valve 14. Note that the central seal 38A on the inside of the valve 14 against the valving plate 40 is larger than the central seal 38B of the valve 14 against the porting end plate 20. The reason for this is that the seal 38A seals fluid from the wobblestick drive connection access hole 50 in plate 40. The seal 38A must be of a sufficient diameter to continually seal this hole 50 during the entire orbiting motion of the valve 14. The seal 38A must therefor have a radius greater than the radius of the hole 50 plus the amount of orbit offset. Since the hole 50 is of significant diameter, the seal 38A must also have a significant diameter. In contrast, the seal 38B seals the wobblestick drive connection 51 to the valve 14. The seal 38B must be of a diameter to continually seal this connection 51 while at the same time fitting within the diameter of the commutation grove 32 in the end plate 20 (so as to not subject the seal to inordinate wear). The seal 38B must therefor have a diameter larger than the connection 51 and also a diameter smaller than the radius of the groove 32. The size of the seal 38B is thus normally different from the size of the seal 38A. Outer seals 39 prevent fluid from passing between the central section 34 and the space 36 about the outer edge 35 of the valve 14. (Note that any seal 39 on the outer ring of the valve 14 against the manifold plate 21 would travel over the valve openings 45 for the device, subjecting such seal to significant wear. Therefor in the preferred embodiment shown the seal at this point is limited to the flat steel of the outer ring of the valve 14; this flat steel having no edges is not subject to the wear a conventional seal would be).

Any fluid that does leak through the seals 38 into the central wobblestick cavity is easily drained off: the fluid would be of very low volume and would be unpressurized. The device shown in FIG. 1 has an internal drain connection for this fluid. In this device a passage 61 connects the central opening 56 to the housing ring-shaped channel 62 in the valve spacing plate. The ring-shaped channel 62 is in turn connected via check valves 63, 64 to the two ports 30, 31 respectively for the device. These check valves 63, 64 operate to selectively connect the ring channel 62 (and thus the central opening 56 of the housing 11) to the port 30, 31 having the lowest relative pressure. This provides an automatic internal drain for any fluid in the central opening 56.

Due to the confinement of the high pressure to the area near the valve 14, the invention of this application allows one to treat the gerotor structure 13 as a self-contained unit. The associated mechanical structure (like housing 11) need not have high pressure seals or other fluid containment means. The gerotor structure unit can be bolted onto a housing 11 or otherwise integrated into mechanical structures with little regard for the existence of the high pressure fluid within the gerotor structure 13. This fluid isolation allows the functions of the drive shaft 12 and housing 11 to be incorporated into the mechanical structures without the need for incorporating high pressure seals in such mechanical structures, significantly shortening the effective longitudinal length of the device. The fluid isolation also allows one to remove the gerotor structure 13 from its associated mechanical structure without regard for the fluid in the gerotor structure. Both the gerotor and mechanical structure can thus be easily interconnected, separated and repaired without regard for the other. Other advantages also flow from the isolation of fluid within the gerotor structure 13.

The plate 23 is a thin plate trapped between the housing 11 and gerotor 22. The plate 23 generally seals the gerotor structure 13 against fluid leakage. If desired a small pocket can be incorporated behind it in the housing 11 which pocket is connected to a high pressure feed. This could be accomplished for example by including holes running axially through the rotor terminating at each face of the rotor. Other holes in the manifold plate 21 and plate 23 would be located within the confines of the area continually swept by the holes in the rotor. The holes in the rotor would sweep the holes in the manifold plate that are pressurized by high pressure, with the hole in the rotor in turn sweeping the holes in the plate 22 to pressurize the pocket in the housing 11. The pressure of fluid in the pocket in the housing would in turn force the plate 22 back towards the rotor pressure balancing same. If the device is designed for bi-directional rotation, small check valves could be utilized to insure the appropriate high pressure only connection. The size of the pocket in the housing 11 would be designed to match the rotor's axial imbalance for the incoming high pressure. The balancing plate is described in detail in the U. S. Pat. No. 4,717,320 by Mr. White.

The wobblestick 15 connects the drive shaft 12 to both the rotor 16 and valve 14, translating rotary and orbital forces. The wobblestick 15 is rotatably connected to the rotor 16 with a toothed drive section 18 for transferring forces between the rotor 16 and drive shaft 12. The end of the wobblestick is orbitally connected to the valve 14 via a pin 19 extending axially off of the end of the wobblestick 15 into the wobblestick drive connection 51 of the valve 14. This pin 19 causes the valve 14 to orbit with the wobblestick 15 to valve the device. Normally the wobblestick is merely contained within the central cavity of the device with any specific location due more to chance than design. This produces wear in the device, both at the ends of the wobblestick 15 and in the drive connections. In contrast in the preferred embodiment of the present invention a small flange 70 extending radially of the valve end of the wobblestick 15 cooperates with two reduced diameter plates 40, 43 of the manifold plate 21 to exactly locate the wobblestick 15. In the embodiment shown the flange 70 is designed with a slight taper equal to the angle of the wobblestick 15 to the central axis of the device with the thickness of the flange 70 such that both plates 40, 43 are contacted when the wobblestick 15 is located in its operational position. With this orientation the wobblestick 15 is confined against any axial movement, precisely located in its proper axial position when the device at rest and when operational. This reduces the wear on the device. Note that in the embodiment shown the diameter of the flange 70 is greater than the diameter of the wobblestick access hole 71 in plate 43. This relationship insures that the wobblestick will not separate from the gerotor structure 13. The relationship, however, is not strictly needed; the wobblestick 15 would be located adequately if the flange 70 contacted even a single arc of the plates 40, 43—and given the angular offset of the wobblestick this could occur with a hole even larger than the flange 70 (as long as the difference in radii was less than the distance of offset of the wobblestick at the contact plane between flange 70 and plate).

In its orbiting motion the valve 14 connects the port 30 through the central opening 34 to some gerotor cells of the gerotor device 22 while connecting the port 31 through the surrounding edge 35 to others of gerotor cells of the gerotor device 22 through the manifold plate 21 as is customary for separate orbiting valve devices. In a major point of departure, however, fluid is generally isolated totally within the gerotor structure 13; neither the central opening 55 of the rotor 16 nor the central opening 56 of the housing 11 are connected to any source of fluid; the fluid of one port 30 is sealed from these openings by means of the seal 38 and the fluid of the other port 31 is sealed from these openings by means of the seals 38 and 39. Any residue fluid that does manage to get into the openings or otherwise into this section of the device is easily drained off via a small passage 60 leading off of the openings to an external sump (as 86).

Due to the fluid isolation, the gerotor structure 13 forms a separate, totally integral device. This device can be attached and separated at any time without any concern for the condition of the fluid pressure fed to the ports 30, 31. The device can also be utilized with housings 11 not designed or otherwise supplied with high pressure seals. This isolation allows one to utilize gerotor structures in a greater variety of devices. Therefor, although the invention has been described in its preferred form with a certain degree of particularity, it is to be understood that numerous changes and deviations may be made without departing from the invention as hereinafter claimed.

What is claimed is:

1. An improvement for a device having a housing with a stationary body and an orbiting valve selectively interconnecting fluid of two ports to expanding and contracting motor cells through bi-directional fluid passages through the stationary body of the housing of the device, the orbiting valve directly rotated by an orbiting drive shaft extending through a central opening of the device to connect to the valve with the diameter of the central opening being larger than the diameter of the drive shaft extending therethrough, the improvement of the addition of a means to seal the central opening from the fluid, in the orbiting valve.

2. The improvement of claim 1 wherein the orbiting valve has an inside drive surface and characterized in that said means to seal the central opening of the device includes the inside drive surface of the orbiting valve.

3. An improvement for a device having a housing with a stationary body and an orbiting valve selectively interconnecting fluid of two ports to expanding and contracting motor cells through bi-directional fluid passages through the stationary body of the housing of the device, and a manifold containing the bi-directional fluid passages connecting the fluid of the two ports from the orbiting valve to the expanding and contracting motor cells on a single side of the expanding and contracting motor cells with the bi-directional passages extending between such cells and the valve, the orbiting valve directly rotated by an orbiting drive shaft extending through a central opening of the device to connect to the valve with the diameter of the central opening being larger than the diameter of the drive shaft extending therethrough, a means to seal the central opening from the fluid in the orbiting valve and in that the manifold of multi-plate construction.

4. An improvement for a device having an orbiting valve selectively interconnecting fluid of two ports to manifold openings at a surface, and the orbiting valve having an inner opening of a certain radius about an inside drive surface and a certain orbit offset, the orbiting valve directly rotated by (A) an orbiting drive shaft extending through a central opening in the surface of the manifold and the central opening having a certain radius with the diameter of the central opening being larger than the diameter of the drive shaft extending therethrough, the improvement comprising the minimum radius of the inner opening of the orbiting valve being greater than the sum of the radius of the central opening plus the orbit offset for the device with the inside drive surface of the orbiting valve sealing the central opening in the surface of the manifold such that the inner opening of the orbiting valve never communicates with the central opening of the manifold.

5. The improvement of claim 4 wherein there is a manifold connecting the orbiting valve to the expanding and contracting motor cells on a single side of the expanding and contracting motor cells between such cells and the valve containing valving passages therebetween and characterized in that the manifold is of multiplate construction.

6. An improvement for a device having an orbiting valve selectively interconnecting fluid of two ports to manifold openings at a surface, the orbiting valve having an inner valving opening of a certain radius about an inside drive surface and a certain orbit offset, the orbiting valve directly rotated by (a) an orbiting drive shaft extending through a central opening in the surface of the manifold to a drive opening in the inside drive surface of the valve, and the central opening of the manifold having a certain radius, and with the diameter of the central opening being larger than the diameter of the drive shaft extending therethrough, the improvement comprising the radius of the inner valving opening of the orbiting valve being greater than the sum of the radius of the central opening plus the orbit offset for the device with the inside drive surface of the orbiting valve sealing the central opening in the surface of the manifold such that the inner valving opening of the orbiting valve never communicates with the central opening of the manifold and by the addition of means to seal the drive opening in the valve from fluid.

7. The improvement for the device of claim 6 wherein device has a central axis, the drive opening has a certain radius and there is a commutation opening connecting a port to the inner valving opening and characterized is that said means to seal the drive opening in the valve from fluid comprises the commutation opening being displaced from the central axis of the device by a distance greater than the sum of the orbit offset plus the radius of the drive opening of the orbiting valve such that the drive opening never communicates with the commutation opening.

8. The improvement of claim 7 characterized in that the commutation opening is a ring channel, said ring channel having a minimum radius about the central axis of the device, and said minimum radius of said ring channel being greater than the sum of the orbit offset plus the radius of the drive opening of the orbiting valve.

9. An improvement for a device having an orbiting valve having a central opening selectively interconnecting fluid of a port to expanding and contracting cells, the central opening being between a central section and an outside edge connected by radial arms having a width, and the orbiting valve moving against a surface, the improvement comprising means in the surface to allow fluid to bypass the arms of the orbiting valve, said means including passages having a circumferential width greater than the width of the radial arms of the valve.

* * * * *